US005433824A

United States Patent [19]

Richardson

[11] Patent Number: 5,433,824

[45] Date of Patent: Jul. 18, 1995

[54] MELAMINE-FORMALDEHYDE POLYMER FOR CONTROLLING STICKIES

[75] Inventor: Paul F. Richardson, Mt. Lebanon, Pa.

[73] Assignee: Calgon Corporation, Pittsburgh, Pa.

[21] Appl. No.: 23,988

[22] Filed: Feb. 26, 1993

[51] Int. Cl.[6] ..... D21C 9/08

[52] U.S. Cl. ..... 162/8; 162/5; 162/199; 162/DIG. 4

[58] Field of Search ..... 162/199, DIG. 4, 5, 162/8, 166, 167

[56] References Cited

U.S. PATENT DOCUMENTS

| | | | |
|---|---|---|---|
| 3,582,461 | 6/1971 | Lipowski et al. . | |
| 3,703,563 | 11/1972 | Lipowski | 162/DIG. 4 |
| 3,812,055 | 5/1974 | Carstens et al. . | |
| 3,895,164 | 7/1975 | Carstens et al. . | |
| 3,896,046 | 7/1975 | Carstens et al. . | |
| 3,992,249 | 11/1976 | Farley . | |
| 4,313,790 | 2/1982 | Pelton et al. . | |
| 4,608,123 | 8/1986 | Leahy | 162/DIG. 4 |
| 4,629,572 | 12/1986 | Leitz et al. . | |
| 4,656,059 | 4/1987 | Mizuno et al. . | |
| 4,935,149 | 6/1990 | Morse . | |
| 4,950,361 | 8/1990 | Bender et al. . | |
| 4,995,944 | 2/1991 | Aston et al. | 162/199 |
| 5,068,279 | 11/1991 | Morse . | |
| 5,223,097 | 6/1993 | Wassler | 162/199 |
| 5,286,347 | 2/1994 | Richardson | 162/199 |

FOREIGN PATENT DOCUMENTS

| | | |
|---|---|---|
| 0280445 | 10/1990 | European Pat. Off. . |

*Primary Examiner*—Karen M. Hastings
*Attorney, Agent, or Firm*—W. C. Mitchell; C. G. Cochenour

[57] ABSTRACT

A method for controlling, inhibiting the deposition of and/or for removing stickies from the surfaces of pulping and papermaking machinery in secondary fiber operations by adding an effective amount of a melamine formaldehyde-type polymer to a pulp slurry or furnish containing secondary fiber that is in contact with said machinery. Improved paper end products resulting from this method are also disclosed.

6 Claims, No Drawings

MELAMINE-FORMALDEHYDE POLYMER FOR CONTROLLING STICKIES

BACKGROUND OF THE DISCLOSURE

The present invention relates to the use of melamine formaldehyde-type polymers to control and/or inhibit stickies deposition in secondary fiber pulping and papermaking processes. More particularly, this invention relates to inhibiting the deposition of stickles or tackles on machinery used in secondary fiber pulping and papermaking processes and to the removal of stickles from machinery used in secondary fiber pulping and papermaking processes. Improved paper products resulting from use of the instant method are also included within the scope of this invention.

Stickies and tackles continue to be a problem in secondary fiber pulp and paper mills. It is believed that the problems caused by the build up of stickies and tackles on pulp and papermaking machinery and in the final paper cost the pulp and paper industry many millions of dollars per year in lost production. The terms "stickles" and "tackies" as used herein, are interchangeable terms that primarily include synthetic contraries found in secondary fiber. For example, stickles and tackles include, but are not limited to, ink residuals, tars, latexes, adhesives and heat melt contaminants found in secondary fiber and in systems where paper produced in a mill is used as broke. As such, stickies and tackies are distinct from pitch, which is defined as any resin-based deposit of widely varying constituency originating in the extractive fraction of wood. The extractive fraction of wood is a complex mixture of substances which are soluble in water, alcohol, benzene, ether, and/or acetone. The extractive fraction, which generally makes up from about 3% to 10% of the weight of wood, contains such components as low molecular weight carbohydrates, terpenes, aromatic and aliphatic acids, alcohols, tannins, color substances, proteins, lignins, alkaloids, and soluble lignins. The constituents of pitch are naturally occurring, as opposed to the synthetic compounds that comprise stickies. While pitch and stickies cause similar problems in papermaking operations, they are distinct both in terms of their origin and their composition.

Stickles and tackies are a major problem in secondary fiber pulp and papermaking operations because they (1) agglomerate and also occlude other matter to form visible "dirt" in the final paper, (2) plate out and collect on machinery used in pulping and papermaking process such as screens, filters refining equipment, pulp washers, and paper machines, and (3) reduce pulp brightness and brightness stability. The composition and amount of stickies deposited on pulping and papermaking machinery and in the final paper varies with the type of secondary fiber used in the pulping operation. As used herein, the term "secondary fiber" includes any paper fiber used for a second time in the production of a paper end-product.

Sources of secondary fiber include, but are not limited to, tissue, fine paper, boxboard, linerboard, foodboard and newsprint. Each of these sources generally contains unique impurities, such as inks, colors, fillers, strength resins and/or coatings, which means that the stickies composition and concentration can vary widely from one secondary fiber to another.

The presence of calcium carbonate in the pulping process generally exacerbates the problem of stickies deposition on pulp and papermaking machinery. Crystallized calcium carbonate can provide nucleation sites for precipitated metal soaps thereby producing hydrophobic particles which coalesce with other particles to form a stickies deposit.

There have been many attempts over the years to eliminate stickies problems by adding control agents to secondary fiber pulping and/or papermaking processes. While more thorough deinking and pulp washing operations may help to reduce stickies problems, the most common methods of treatment involve the addition of dispersants or adsorbent fillers to the furnish. For example, treatments may involve the use of zirconium compounds, alum, talc, anionic stickies-control agents such as polynaphthalene sulfonates or modified lignosulfonates, cationic control agents such as polyquaternary ammonium polymers, methylcellulose derivatives and nonionic surfactants. None of these treatments are believed to be particularly effective for stickles control.

Examples of the use of poly quaternary ammonium polymers as pitch control agents can be found in U.S. Pat. No. 3,582,461. The '461 patent discloses the use of water soluble dicyandiamide-formaldehyde condensates to prevent pitch deposition on machinery used in pulping and papermaking processes. By contrast, the instant invention utilizes water insoluble acid colloids for stickles control.

Examples of attempts to control pitch with other types of compounds or processes are found in U.S. Pat. Nos. 3,812,055; 3,895,164; 3,896,046; 3,992,249; 4,313,790.

Zirconium chemicals have also been used to control pitch and stickies. See, for example, U.S. Pat. No. 4,950,361.

The instant melamine formaldehyde-type polymers are widely used in water treatment, particularly in the treatment of paint spray booths. See, for example, U.S. Pat. Nos. 4,656,059, 4,629,572, 4,935,149 and 5,068,279.

Copending and commonly assigned application U.S. Ser. No. 07/878,637, now U.S. Pat. No. 5,286,347, relates to the use of melamine-formaldehyde-type polymers as pitch control agents.

The use of melamine formaldehyde-type polymers to control stickies deposition in papermaking is not known or suggested in the art.

As indicated above, the present invention relates primarily to the inhibition and/or control of stickies in secondary fiber papermaking operations. For purposes of this invention, pitch is defined as the material comprising naturally occurring resinous materials and gums liberated during the screening, heating and refining processes that occur during papermaking. Stickies, on the other hand, are defined as synthetic impurities which are present in secondary fiber paper furnishes. More particularly, stickies are defined as adherent deposits caused by organic materials used in paper and board coating and converting operations which are typically introduced into paper machine furnishes with recycled fibers. The word "stickies" is derived from the fact that the resultant deposits stick to wires, felts, and other parts of paper machine. Stickies also trap inorganic components found in papermaking furnishes. Stickies are a diverse mixture of synthetic materials ranging from hot-melt and pressure-sensitive adhesives to binders and coatings for inks or wet strength resins. Polymeric examples include, for example, polyethylenes, polybutadiene-styrenes, polyvinylacetates and polyacrylates.

SUMMARY OF THE INVENTION

The instant invention is directed to the control and/or inhibition of stickles and tackies deposits on and to the removal of stickies and tackles deposits from pulping and/or papermaking machinery, particularly wet-end papermaking machinery, comprising adding to a stickies-containing pulp slurry or paper furnish in contact with said machinery an effective amount of a designated melamine formaldehyde-type polymer. Improved end products resulting from the instant method are also claimed.

DETAILED DESCRIPTION OF THE INVENTION

The present invention relates to a method for controlling and/or inhibiting stickies and/or tackies deposition on pulping or papermaking equipment or machinery in contact with a furnish, stock or papermaking stream containing stickies and/or tackies, and/or for removing existing stickies/tackies deposits from such equipment or machinery, comprising adding to a said furnish, stock or papermaking stream containing stickies or tackles, particularly a furnish, stock or papermaking stream containing secondary fiber, with an effective amount of a melamine formaldehyde-type polymer. This method can also be used to control stickies in systems where paper produced in the mill being treated is used as broke.

The instant invention is also directed to a composition comprising: a) a furnish, stock or papermaking stream, particularly a secondary fiber furnish, stock or papermaking stream, containing stickies; and b) at least about 0.01 lb., based on active polymer weight, per ton of dry fiber in said furnish, stock or papermaking stream, of a melamine formaldehyde-type polymer. The present invention is also directed to the paper product produced of the instant method, i.e., an improved paper end product prepared from a furnish, stock or papermaking stream containing stickies treated with an effective amount of a melamine formaldehyde-type polymer.

An effective amount of a melamine formaldehyde-type polymer must be used. As used herein, the melamine formaldehyde-type polymer is a polymer comprising: (a), melamine or a substituted melamine; and (b) a compound described by the following formula:

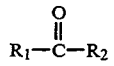

wherein $R_1$ and $R_2$, which may be the same or different, are selected from the group consisting of H and straight or branched $C_{1-4}$ alkyl groups. The preferred compounds of (b) comprise aldehydes, with methanal (formaldehyde), ethanal and propanal being especially preferred; the most preferred aldehyde is formaldehyde. Also, moderate amounts of additional moieties, including, for example, urea and/or dicyandiamide, may be present in the melamine formaldehyde-type polymers of this invention.

Irrespective of the presence of additional moieties, however, the mole ratio of component (a) to component (b) should range from about 1:1 to about 1:6, with the preferred ratio being from about 1:1 to 1:3. The most preferred mole ratio is about 1 mole of melamine or a derivative thereof to about 2 to 2.5 moles of an aldehyde. Thus, the most preferred polymer is prepared from melamine and formaldehyde with the mole ratio of melamine to formaldehyde being about 1:2 to about 1:2.5.

The instant melamine-formaldehyde polymers are insoluble in water. They are therefore best utilized in acidic solutions wherein the melamine polymer is stabilized in a fine colloidal state of suspension. Calgon's product CA-289, which has a pH of about 1.6 to about 2.1, is an example of the preferred form. This product contains 8% active melamine-formaldehyde polymer in an acidic aqueous solution. Any acid can be used to prepare the melamine aldehyde acid suspension, although hydrochloric acid is preferred. Also, other stabilizing agents, such as alcohols, can be used.

The percent by weight of active melamine polymer in a stabilized (acidic) suspension or solution should range from about 0.1% to about 20%, preferably 1% to about 15%, and most preferably about 4% to about 12%, due to cost and product stability considerations. The pH should be sufficiently low to keep the melamine aldehyde-type polymer in a fine colloidal suspension.

The molecular weight of the melamine aldehyde-type polymer is not critical. However, the preferred molecular weight ranges from about 500 to about 50,000, and the most preferred molecular weight ranges from about 500 to about 5,000. As noted above, suitable melamine aldehyde-type polymers are commercially available from Calgon Corporation, under the tradenames CA-289 and WT-2511. These products have molecular weights of about 2,200.

An effective amount of the melamine formaldehyde-type polymer should be added to or maintained in the furnish, stock or papermaking stream being treated. The melamine polymer interacts with the stickies/tackies contaminants contained in such streams, thereby inhibiting stickies/tackies deposition and/or removing existing stickles/tackles deposits from the surfaces of papermaking equipment. As used herein, the term "effective amount" refers to that amount of melamine formaldehyde-type polymer which achieves the desired control, inhibition or removal of stickles for a given system.

The melamine polymer can be applied intermittently or continuously to the papermaking stream being treated at a preferred dosage of at least about 0.01 lb. polymer per ton of dry fiber, on an active polymer basis. More preferably, the dosage should be maintained between about 0.40 lb/ton to about 10.0 lb/ton. The melamine formaldehyde-type polymer can be added at any convenient location, but is preferably added so as to allow the maximum contact between the melamine formaldehyde-type polymer and the stickles/tackles. For example, the melamine formaldehyde-type polymer may be added to secondary fiber washers, deckers, high density chests or machine dilution chests. Also, multiple points of addition may be used.

EXAMPLES

Example 1—Mixed Office Waste

A melamine-formaldehyde acid colloid, commercially available from Calgon Corporation as CA-289, was fed to a secondary fiber furnish prepared from a mixed office waste containing 3% by weight fiber, deinking chemicals, ink solids and bleach. The polymer dosage, on an active basis, was 0.65 lb/ton. Hand sheets were then prepared from the treated and untreated furnishes. The untreated hand sheets contained large tacky particles with fiber attached to them. The treated hand sheets contained smaller, non tacky particles with fewer fibers attached. These tests demonstrated the ability of the melamine-formaldehyde polymer to impede agglomeration of stickies particles. These tests also demonstrated the ability of CA-289 to render the surfaces of the stickies non-tacky.

What is claimed is:

1. A method for inhibiting stickies deposition on pulping or papermaking equipment or machinery in contact with a pulp slurry containing stickies, comprising adding to said pulp slurry containing stickies, an effective amount of a water-insoluble melamine formaldehyde-type polymer acid colloid, wherein said water-insoluble melamine formaldehyde-type polymer acid colloid comprises (a), melamine or a substituted melamine; and (b) a compound described by the following formula:

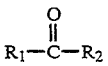

wherein $R_1$ and $R_2$, which may be the same or different, are selected from the group consisting of H and straight or branched $C_{1-4}$ alkyl groups, wherein the melamine formaldehyde-type polymer has a molecular weight range from about 500 to about 5,000, and said effective amount is between about 0.01 lb. to about 10 lb. polymer per ton of dry fiber.

2. The method of claim 1, wherein said pulp slurry, contains secondary fiber.

3. The method of claim 1, wherein b) is formaldehyde.

4. The method of claim 1, wherein the mole ratio of a):b) is about 1:1 to about 1:6.

5. The method of claim 3, wherein the mole ratio of a):b) is about 1:1 to about 1:6.

6. The method of claim 1, wherein said pulp slurry is in a mill where said slurry contains broke.

* * * * *